US006232540B1

(12) United States Patent
Kondo

(10) Patent No.: US 6,232,540 B1
(45) Date of Patent: May 15, 2001

(54) TIME-SCALE MODIFICATION METHOD AND APPARATUS FOR RHYTHM SOURCE SIGNALS

(75) Inventor: Kazunobu Kondo, Hamamatsu (JP)

(73) Assignee: Yamaha Corp., Hamamatsu (JP)

( * ) Notice: Subject to any disclaimer, the term of this patent is extended or adjusted under 35 U.S.C. 154(b) by 0 days.

(21) Appl. No.: 09/565,605

(22) Filed: May 4, 2000

(30) Foreign Application Priority Data

May 6, 1999 (JP) ..... 11-126349

(51) Int. Cl.[7] ..... G10H 7/00

(52) U.S. Cl. ..... 84/612; 84/652; 434/307 A; 704/503

(58) Field of Search ..... 704/503, 504; 434/307 A; 84/611, 612, 635, 636, 651, 652, 667, 668

(56) References Cited

U.S. PATENT DOCUMENTS 4,864,620 * 9/1989 Bialick .
5,256,832 * 10/1993 Miyake .
5,386,493 * 1/1995 Degen et al. .
5,611,018 * 3/1997 Tanaka et al. .
5,781,885 * 7/1998 Inoue et al. ..... 704/500 X
5,842,172 * 11/1998 Wilson ..... 704/503
6,049,766 * 4/2000 Laroche ..... 704/503 X

FOREIGN PATENT DOCUMENTS 12829630 10/1998 (JP) ..... G10H/7/00

OTHER PUBLICATIONS

Morita, Naotaka & Fumitada Itakura, School of Engineering, Nagoya University, "Time–Scale Modification Algorithm for Speech by Use of Pointer Interval Control Overlap and Add (PICOLA) and its Evaluation", pp. 149–150.

* cited by examiner

*Primary Examiner*—Jeffrey Donels
(74) *Attorney, Agent, or Firm*—Pillsbury Winthrop LLP

(57) ABSTRACT

A time-scale modification method or apparatus is basically designed to effect a time-scale modification process (i.e., expansion or compression with respect to time) on rhythm source signals containing waves such that rhythm sounds are not substantially changed in pitches. Herein, attack positions are detected from the rhythm source signals by using thresholds which are determined in advance. Hence, the time-scale modification process is performed on intermediate signal portions of the rhythm source signals between the attacks in accordance with a desired time-scale modification factor. Then, the intermediate signal portions subjected to the time-scale modification process are smoothly connected with other signal portions such as the attacks and their proximal portions, which are not subjected to the time-scale modification process. Therefore, it is possible to secure the attacks and their proximal portions, which are left without being substantially changed, while accomplishing the time-scale modification on the rhythm source signals. Thus, it is possible to avoid occurrence of double beat and rhythm disorder in rhythm sounds, which are conventionally caused to occur by the time-scale modification.

19 Claims, 10 Drawing Sheets

Time
T0
Lmax
Lmax
Lmin
Lmin

Time
Lp
Lp
L

Wave A
Wave B
Time
T0
T0 + L

Wave A
Time

Wave B
Time

L−2*Lp
Wave A + Wave B
New T0

Time
T0
Lmax
Lmax
Lmin
Lmin

Time
Lp
Lp
L

Wave A
Wave B
Time
T0
T0+L

Time

+
Time
L–2* Lp

Time
Wave A
Wave A + Wave B
Wave B
New T0

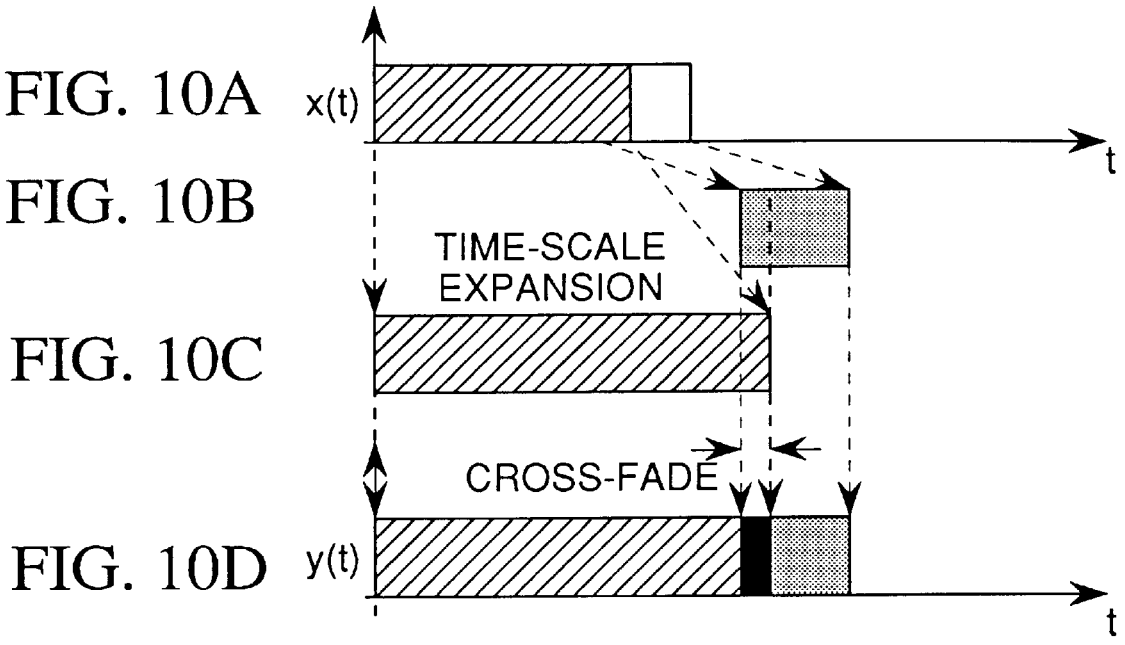
FIG. 10A
x(t)
t
FIG. 10B
TIME-SCALE
EXPANSION
FIG. 10C
CROSS-FADE
FIG. 10D
y(t)
t
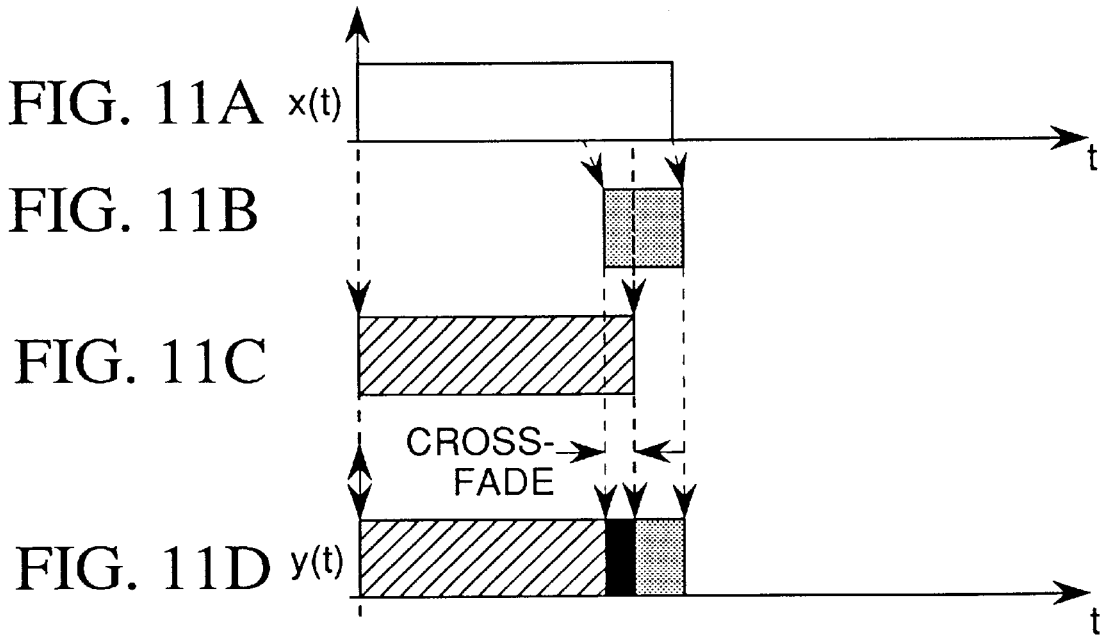
FIG. 11A
x(t)
t
FIG. 11B
FIG. 11C
CROSS-
FADE
FIG. 11D
y(t)
t

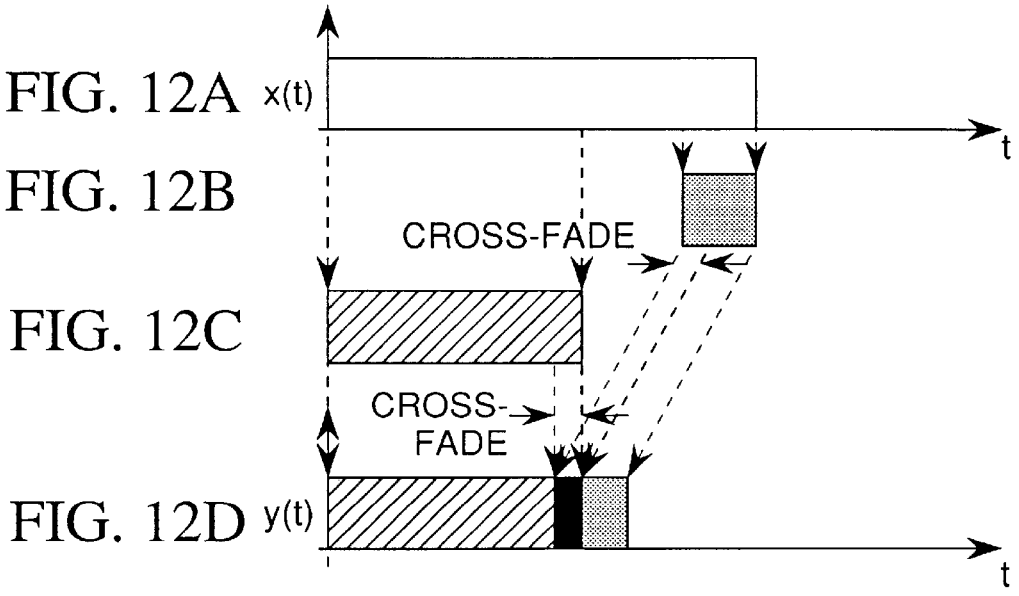
FIG. 13
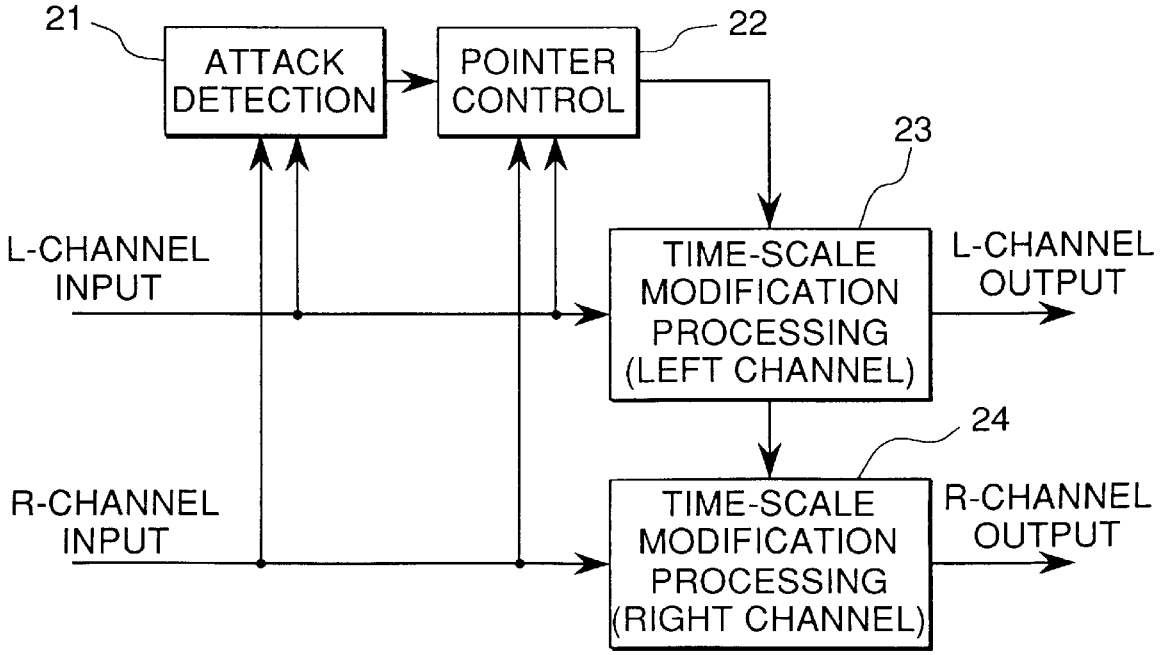

TIME-SCALE MODIFICATION METHOD AND APPARATUS FOR RHYTHM SOURCE SIGNALS

BACKGROUND OF THE INVENTION

1. Field of the Invention

This invention relates to time-scale modification methods and apparatuses that perform time-scale modification on digital signals, which are modified without being changed in original pitches with respect to time scale in accordance with desired time-scale modification factors. Particularly, this invention relates to time-scale modification of rhythm source signals.

This application is based on Patent Application No. Hei 11-126349 filed in Japan.

2. Description of the Related Art

Normally, time-scale modification techniques are effected to perform compression and expansion on digital audio signals with respect to time, wherein the digital audio signals are not changed in pitches. Those techniques are used in a variety of fields such as in so-called "scale adjustment" in which an overall recording time of digital audio signals being recorded is adjusted to a prescribed time and "tempo modification" used by Karaoke apparatuses, for example. Conventionally, engineers and scientists propose various examples of time-scale modification techniques. For example, Japanese Unexamined Patent Publication No. Hei 10-282963 teaches a cut-and-splice method in time-scale modification processing. In addition, an example of a time-scale modification algorithm is taught by the paper entitled "Time-Scale Modification Algorithm for Speech by Use of Pointer Interval Control Overlap and Add (PICOLA) and Its Evaluation", which is written by Morita and Itakura on pp. 149–150 of monographs 1-4-14 issued for the autumn meeting of Japan Acoustics Engineering Society in October of 1986.

In general, the cut-and-splice method is used for time-scale modification processing to perform compression or expansion on signal waveforms (or envelopes) in accordance with a designated time-scale modification factor (e.g., compression factor or expansion factor), as follows:

Waveforms are divided into and cut to segments, regardless of correlation therebetween. Then, the cut segments of the waveforms are spliced together to achieve the time-scale modification in accordance with the designated time-scale modification factor. Herein, discontinuity is caused to occur at joints by which the cut segments of the waveforms are spliced together. To reduce the discontinuity, a cross-fade process is effected on the joints to smoothly connect the joints of frames. Intervals of distance (referred to as "cut intervals") by which the waveforms are cut to segments are set such that it is difficult for listeners to sense echoes or sound repetition given human auditory capabilities. For example, the cut intervals are set at 60 millisecond or so. The aforementioned publication teaches a splendid method in which cut lengths of waveforms are determined in synchronization with speech timing information. As compared with general methods, the aforementioned method is advantageous in that variations in sound quality are relatively small at joints of waveform segments being spliced together because the joints emerge by the same period of rhythm as that of the original waveforms.

According to the aforementioned PICOLA method, two segments are extracted from a waveform of an original audio signal. Herein, the two segments each having the same length are arranged to adjoin each other on the waveform with highest correlation therebetween. Signals of those segments are subjected to duplicate addition to produce a specific signal, which is substituted for the original two segments or which is inserted between them. Thus, it is possible to shorten or extend an overall time sustaining the waveform. This method is advantageous in that connection between waveform segments can be made smooth as compared with the cut-and-splice method. Particularly, this method enables high-quality time-scale modification on highly-pitch-dependent sound sources that produce speech signals, musical tone signals of monophonic musical instruments and the like.

In general, the conventional cut-and-splice method has merits in which appropriate sound qualities are expected with respect to many types of sound sources. In the case of rhythm sources, however, it suffers from noticeable deterioration of sound quality such as "double beat" and "disorder in rhythm". The aforementioned publication teaches the cut-and-splice method which is effected in synchronization with the rhythm of the original waveform. In some cases, two attacks are included in each of the segments which are cut from original waveforms. When expanding the waveforms consisting of the cut segments being spliced together with respect to time, a double-beat phenomenon is caused to occur. In contrast, the PICOLA method does not cause such a double-beat phenomenon in principle thereof because time-scale modification is performed in connection with time correlation of waveforms. However, the PICOLA method does not at all compensate for attack positions on waveforms being reproduced by time-scale modification. This causes a rhythm deviation to occur with ease.

SUMMARY OF THE INVENTION

It is an object of the invention to provide a time-scale modification method and apparatus that inhibits rhythm disorder and double beat from being caused to occur by compensating attack positions on waveforms being reproduced by effecting time-scale modification on rhythm source signals.

A time-scale modification method or apparatus of this invention is basically designed to effect a time-scale modification process (i.e., expansion or compression with respect to time) on rhythm source signals containing waves such that rhythm sounds are not substantially changed in pitches. Herein, attack positions are detected from the rhythm source signals by using thresholds which are determined in advance. Hence, the time-scale modification process is performed on intermediate signal portions of the rhythm source signals between the attacks in accordance with a desired time-scale modification factor. Then, the intermediate signal portions subjected to the time-scale modification process are smoothly connected with other signal portions such as the attacks and their proximal portions, which are not subjected to the time-scale modification process. Therefore, it is possible to secure the attacks and their proximal portions, which are left without being substantially changed, while accomplishing the time-scale modification on the rhythm source signals. Thus, it is possible to avoid occurrence of double beat and rhythm disorder in rhythm sounds, which are conventionally caused to occur by the time-scale modification.

Incidentally, the time-scale modification process is effected by a series of steps such as similarity calculation, determination of a basic period, partitioning of waves, windowed multiplication and addition. For example, a combined wave is produced from two waves which are partitioned from original waves of rhythm source signals by the basic period and which are subjected to windowed multiplication and addition. In the case of compression, the combined wave is substituted for the two waves in the original waves, so that the rhythm source signals are compressed as a whole. In the case of expansion, the combined wave is inserted between the two waves in the original waves, so that the rhythm source signals are expanded as a whole.

BRIEF DESCRIPTION OF THE DRAWINGS

These and other objects, aspects and embodiment of the present invention will be described in more detail with reference to the following drawing figures, of which:

FIG. 10A diagrammatically shows data of a back-end portion of an intermediate signal portion between attacks in connection with an un-processed portion;

FIG. 10B shows an amount of data including data needed for cross-fading, which is extracted from the data of FIG. 10A;

FIG. 10C shows data of the intermediate signal portion being expanded;

FIG. 10D shows connection between the data of FIG. 10C and cross-fade data corresponding to a part of the extracted data being subjected to cross-fading;

FIG. 11A diagrammatically shows data of a back-end portion of an intermediate signal waveform between attacks in connection with an un-processed portion;

FIG. 11B shows an amount of data including data needed for cross-fading, which is extracted from the data of FIG. 11A;

FIG. 11C shows data of the intermediate signal portion used for time-scale expansion to cope with a shortage of data;

FIG. 11D shows connection between the data of FIG. 11C and cross-fade data corresponding to a part of the extracted data which is repeatedly used;

FIG. 12A diagrammatically shows data of a back-end portion of an intermediate signal portion between attacks in connection with an un processed portion;

FIG. 12B shows an amount of data including data needed for cross-fading, which is extracted from the data of FIG. 12A;

FIG. 12C shows data being compressed;

FIG. 12D shows connection between the data of FIG. 12C and cross-fade data corresponding to a part of the extracted data; and FIG. 13 is a block diagram showing a configuration of the time-scale modification apparatus which is modified to cope with a stereo sound system.

DESCRIPTION OF THE PREFERRED EMBODIMENT

This invention will be described in further detail by way of examples with reference to the accompanying drawings.

Figure 1:
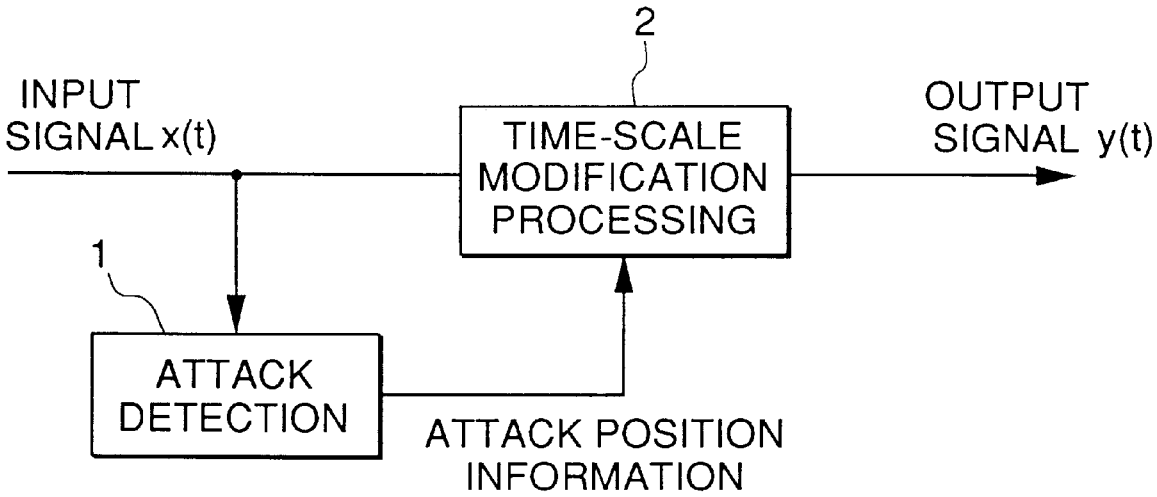
FIG. 1 is a block diagram showing a brief configuration of a time-scale modification apparatus that performs time-scale modification on rhythm source signals in accordance with an embodiment of the invention.

FIG. 1 is a block diagram showing a brief configuration of a time-scale modification apparatus that performs time-scale modification on rhythm source signals in accordance with an embodiment of the invention.

In FIG. 1, digital audio signals x(t) which are rhythm source signals being subjected to time-scale modification are input to an attack detection section 1. Herein, attacks are contained in waveforms of the rhythm source signals, wherein they correspond to concentration and rapid variations in signal power (or signal level) of the waveforms. The attack detection section 1 performs an evaluation with respect to signal power per unit time by using a certain threshold. In addition, the attack detection section 1 detects rapidly varying points of the signal levels on the waveforms by effecting differentiation on the signal power with respect to time. Using the signal power and its differential value produced by the attack detection section 1, it is possible to detect all attacks on waveforms of the rhythm source signals. Incidentally, the attack detection section 1 produces attack position information representing attack positions being detected on the waveforms.

The digital audio signals x(t) are also supplied to a time-scale modification processing section 2. The time-scale modification processing section 2 performs time-scale modification processing (i.e., compression and/or expansion with respect to time) on signals between the attack positions being detected by the attack detection section 1 within the digital audio signals input thereto. Such time scale modification processing can be performed through a variety of methods, including the cut-and-splice method and PICOLA method as well as repetition of reverb, dither and loop. The present embodiment employs the PICOLA method as an example of the time-scale modification being effected by the time-scale modification processing section 2.

Figure 2:
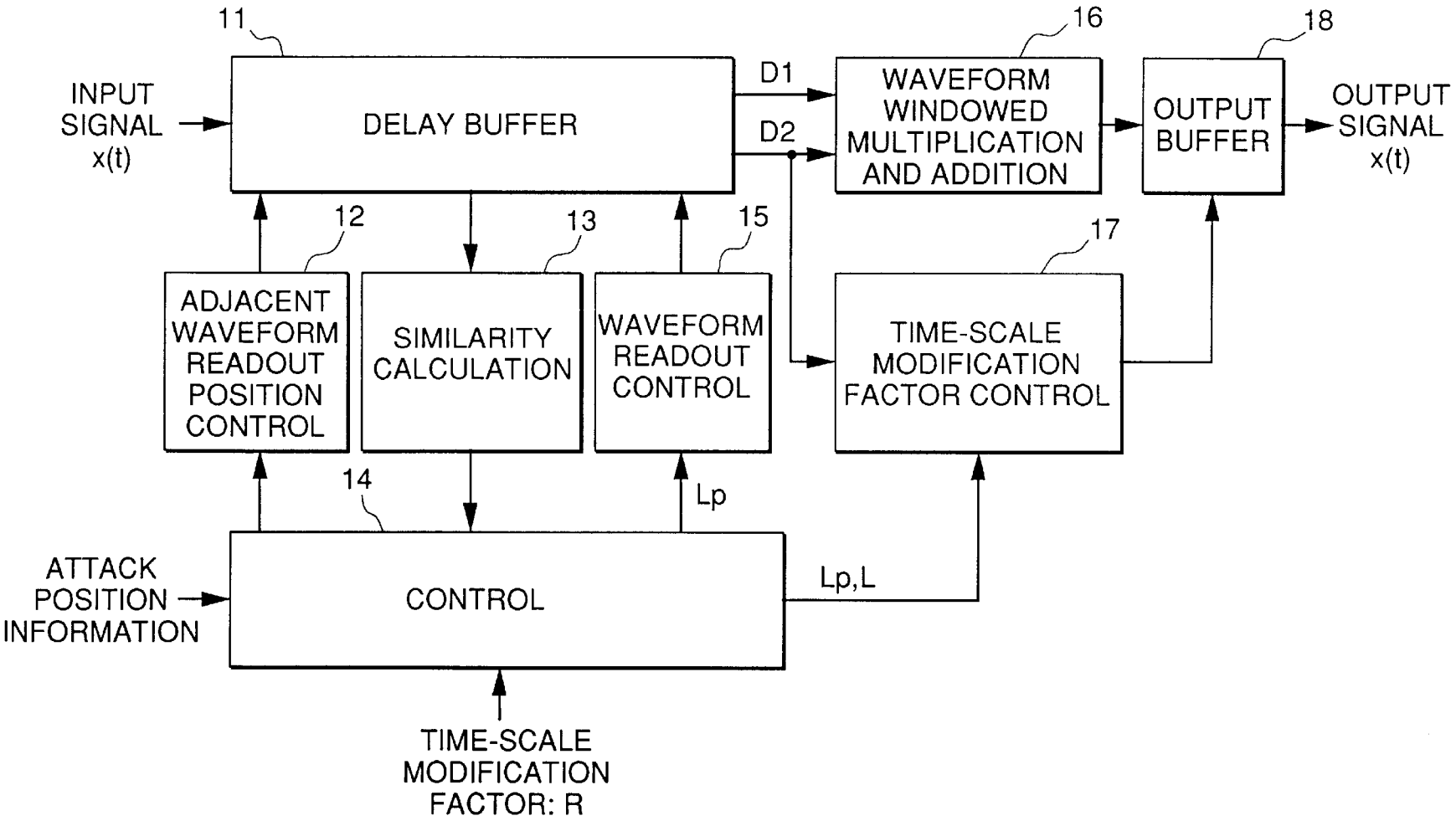
FIG. 2 is a block diagram showing a detailed internal configuration of a time-scale modification processing section shown in FIG. 1.

FIG. 2 is a block diagram showing a detailed internal configuration of the time-scale modification processing section 2.

In FIG. 2, digital audio signals (i.e., input signals x(t)) are input to the time-scale modification processing section 2 wherein they are sequentially stored in a delay buffer 11. The delay buffer 11 is configured by a ring buffer for storing a certain amount of data which are needed for executing time-scale modification processing of waveforms and pitch extraction processes, for example. The digital audio signals stored in the delay buffer 11 are divided into waveform segments by various time lengths under control of an adjacent waveform readout position control section 12, so that they are sequentially read out as adjacent waveform segment data. A similarity calculation section 13 calculates similarities between the adjacent waveform segment data, which are read from the delay buffer 11 under the control of the adjacent waveform readout position control section 12. Based on the calculated similarities, a control section 14 determines a time length by which the adjacent waveform segments are most-similar to each other. The control section 14 sets such a time length as a basic period (or pitch) "Lp", which is forwarded to a waveform readout control section 15. Based on the aforementioned attack position information that the control section 14 receives from the attack detection section 1, the waveform readout control section 15 performs a readout operation to read two data, which are separated from each other by the basic period Lp within signals between attacks, from the delay buffer 11. That is, the delay buffer 11 outputs two data D1, D2 under the control of the waveform readout control section 15. The data D1, D2 are supplied to a time-scale modification processing control unit, which is configured by a waveform windowed multiplication and addition section 16, a time-scale modification factor control section 17 and an output buffer 18. In the waveform windowed multiplication and addition section 16, the data D1, D2 are multiplied with predetermined time window functions and are added together to produce specific waves. The data D2 is also supplied to the time-scale modification factor control section 17. Based on information representing a subject length L of a subject of the time-scale modification processing, the input digital audio signals are divided into and cut to "original" waveform segments under the control of the time-scale modification factor control section 17. Incidentally, the control section 14 calculates the subject length L based on a time-scale modification factor R which is determined in advance and the basic period Lp which is extracted from the lengths. The output buffer 18 combines the waves produced by the waveform windowed multiplication and addition section 16 with the original waveform segments being cut by the time-scale modification factor control section 17. Thus, the output buffer 18 produces output signals y(t), which correspond to results of the time-scale modification processing effected on the input signals x(t).

Next, operations of the time-scale modification apparatus will be described with reference to flowcharts and graphs.

Figure 3:
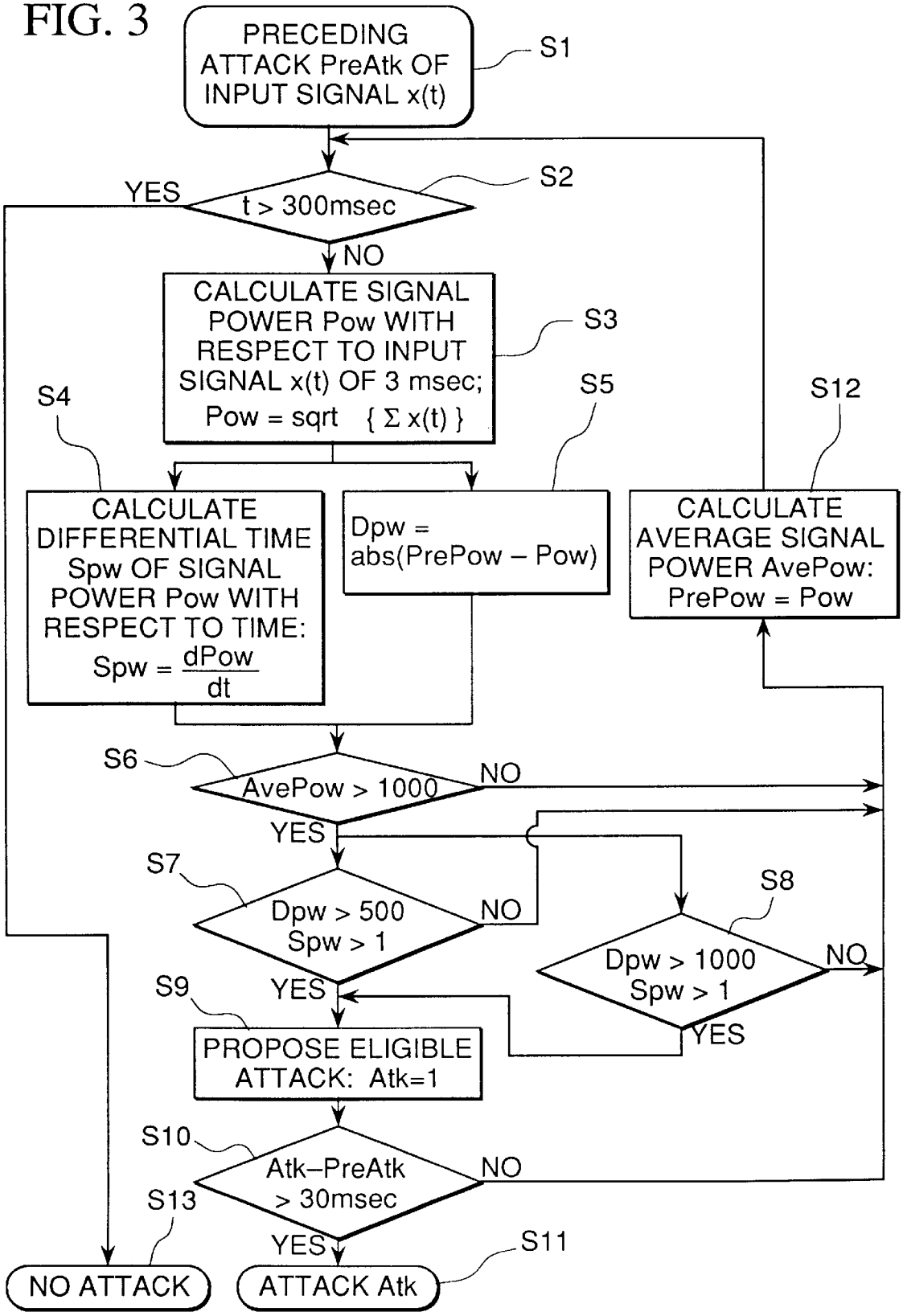
FIG. 3 is a flowchart showing an attack detection process being executed by an attack detection section shown in FIG. 1.

FIG. 3 is a flowchart showing procedures of an attack detection process being executed by the attack detection section 1.

Figure 4:
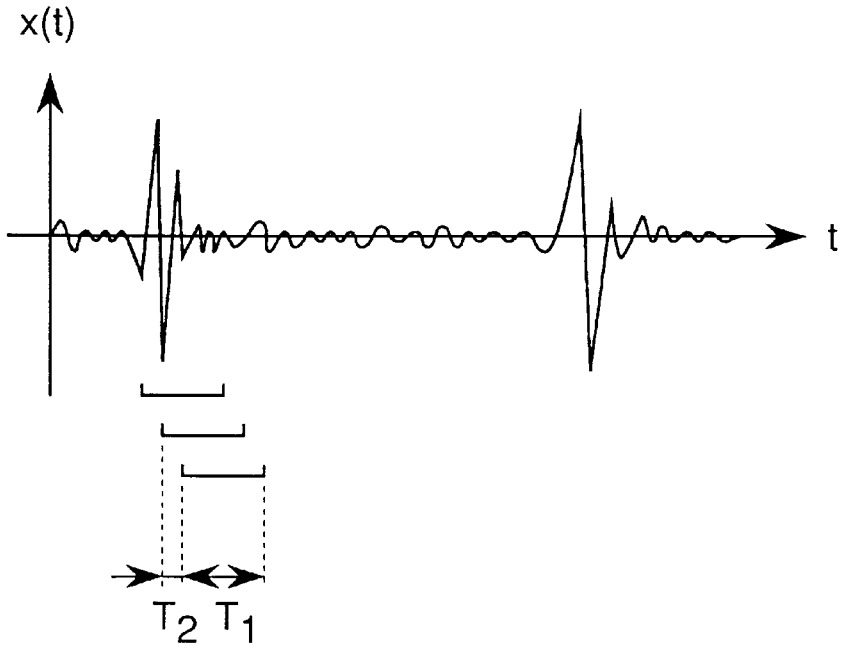
FIG. 4 is a graph showing a signal waveform of an input signal x(t) in connection with a signal power calculation time T1 and a signal power evaluation update time length T2.

An attack position is calculated based on a signal power Pow and its differential value Spw with respect to time. For example, a signal power Pow is produced by performing calculation on a signal of a signal power calculation time T1 (see FIG. 4), which is determined in advance. Herein, the calculation is performed by sequentially updating calculation time with a signal power evaluation update time length T2. The inventor of this invention conducted an examination to determine values for T1, T2 as follows:

It is preferable that the signal power calculation time T1 for attack detection is set at 3 millisecond, while the signal power evaluation update time length T2 is set at 1 millisecond, for example.

So, the following description uses the aforementioned values as T1, T2 respectively.

In step S1 shown in FIG. 3, the attack detection section 1 sets a preceding attack position PreAtk with respect to an input signal x(t) of 3 millisecond. Then, the attack detection section 1 transfers control to step S3 by way of step S2. In step S3, the attack detection section 1 calculates a signal power Pow from the input signal x(t) in accordance with an equation (1), as follows:

$$Pow=sqrt[\Sigma x(t)] \quad (1)$$

Evaluation is performed on the signal power Pow by using a threshold (e.g., "1000", see step S6). Herein, an attack is an initial waveform portion which is rapidly rising in level, while a decay has a certain time length which is relatively long. In step S5, the attack detection section 1 calculates a differential absolute value Dpw corresponding to a difference between the signal power Pow of a present frame and a signal power PrePow of a preceding frame in accordance with an equation (2), as follows:

$$Dpw=abs(PrePow-Pow) \quad (2)$$

In steps S7, S8, detection is made as to whether the differential absolute value Dpw exceeds thresholds or not. Normally, a signal waveform contains a large signal power portion in which an average signal power (AvePow) is relatively large and a small signal power portion in which an average signal power is relatively small. So, it is necessary to change the thresholds between those portions because the differential absolute values Dpw are greatly deviated between those portions. That is, the differential absolute value Dpw should be small with respect to the large signal power portion containing an attack, while it should be large with respect to the small signal power portion in which a rapid level increase occurs at an attack. So, different thresholds are used in evaluation of the differential absolute value Dpw in consideration of the square roots of the signal power Pow, in other words, an amplitude scale of an original signal. Concretely speaking, the step S7 uses a threshold of "500"

with respect to the large signal power portion, while the step S8 uses a threshold of "1000" with respect to the small signal power portion. In addition, the step S6 uses a threshold of "1000" for evaluation of the average signal power AvePow.

In step S4, calculation is performed on the signal power Pow to produce its differential value Spw with respect to time in accordance with an equation (3), as follows:

$$Spw = \frac{d\,Pow}{dt} \tag{3}$$

Actually, the aforementioned calculations provide detection of a position which is slightly preceding to an attack on a signal waveform. For this reason, averaging is performed on three signal powers which are previously produced by the foregoing calculation being performed three times. Then, an averaged value of the signal power Pow is used for the equation (3) to perform differentiation on Pow with respect to time. Incidentally, differentiation of the equation (3) may correspond to gradient calculation with respect to the signal waveform. The aforementioned steps S7, S8 are used to discriminate attacks whose angles of gradient are greater than the prescribed thresholds (e.g., 45 degree).

Through the aforementioned steps, the attack detection section 1 proposes "eligible" attacks. The inventor of this invention conducted an examination to determine that almost all intervals of time between attacks are greater than 30 milli-second. So, steps S10, S11 detect "real" attacks based on a condition where a present attack presently detected is delayed from a preceding attack previously detected by the prescribed interval of time (i.e., 30 milli-second) or more. If the proposed attack in step S9 does not meet such a condition in step S10, the attack detection section 1 proceeds to step S12 in which it updates the average signal power AvePow and preceding signal power PrePow. Then, the attack detection section 1 repeats the foregoing steps again. If no attack is detected during a predetermined period of time which is greater than 300 millisecond in step S2, the attack detection section 1 transfers control directly to step S13 to declare that no attack exists on the signal waveform of the input signal x(t). Hence, the time-scale modification is performed on the input signal x(t) by a unit time of partition corresponding to 300 milli-second.

Figures 5A, 5B:
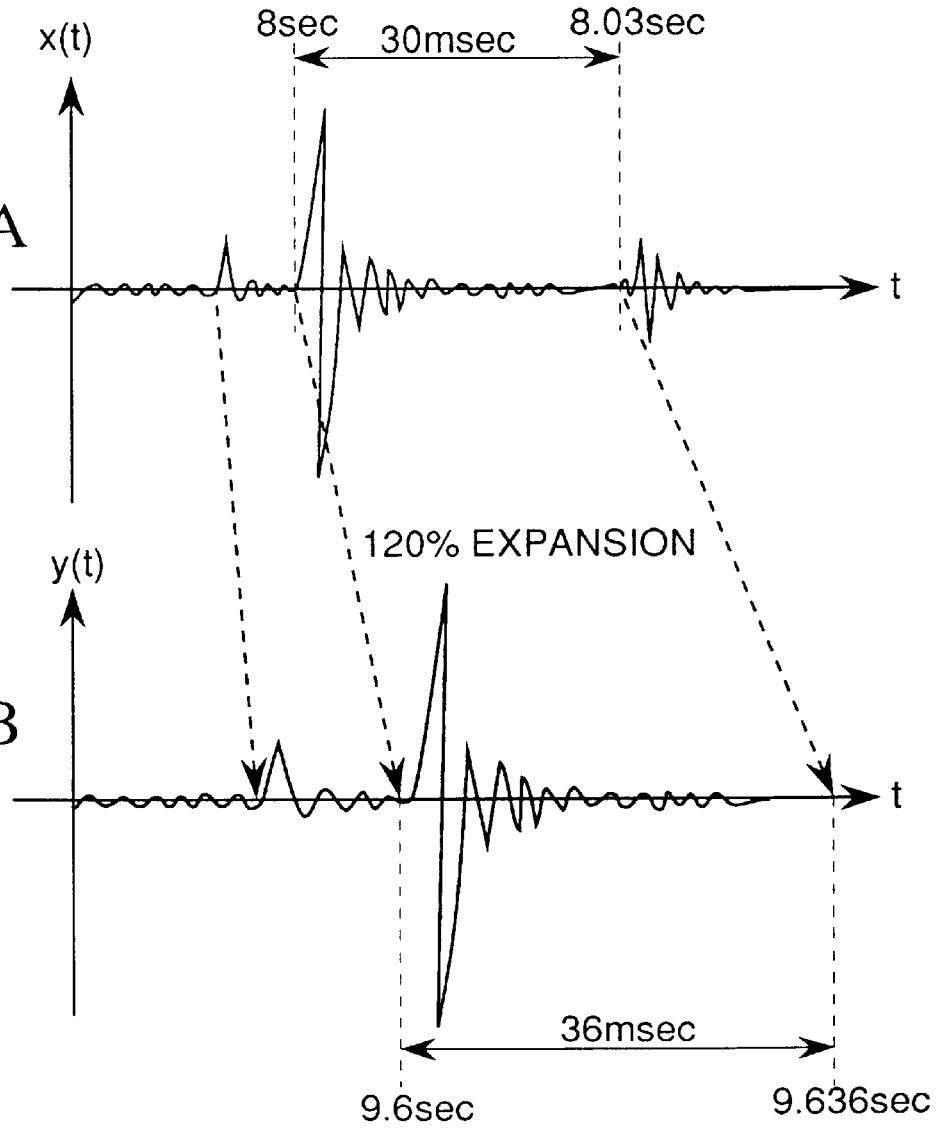
FIG. 5A shows an example of an original signal waveform of an input signal x(t) including attacks.
FIG. 5B shows a signal waveform which is reproduced by effecting time-scale expansion on an intermediate signal portion between the attacks of the signal waveform of FIG. 6A.

An example, one may consider a signal waveform of an input signal x(t) (see FIG. 5A) in which attacks are detected at two positions corresponding to prescribed times of 8 second and 8.03 second respectively. Herein, an intermediate signal portion corresponding to an interval of time of 30 milli-second lies between the attacks on the signal waveform of the input signal x(t). If the expansion factor is 120%, the intermediate signal portion of 30 milli-second between the attacks is expanded to a signal portion of 36 milli-second. By the time-scale expansion of 120%, the input signal x(t) shown in FIG. 5A is converted to an output signal y(t) shown in FIG. 5B. In FIG. 5B, the time-scale expansion processing shifts a first attack position of the input signal x(t), which is originally at the time of 8 second in FIG. 5A, to another position on the output signal y(t) which is at a time of 9.6 second, for example. In that case, a next attack emerges on the output signal y(t) at a time of 9.636 second, which is delayed from the time of 9.6 second by 36 milli-second.

Next, time-scale modification processing by the time-scale modification processing section 2 will be described with reference to graphs shown in FIGS. 6A–6F and FIGS. 7A–7F.

The above-mentioned graphs are used to explain the time-scale modification technique of this invention. Specifically, the graphs of FIGS. 6A–6F are used to explain a compression process, while the graphs of FIGS. 7A–7F are used to explain an expansion process. First, a similarity examination process is performed with respect to adjacent waveform segments, which are disposed along a time axis on an original signal waveform (see FIGS. 6A, 7A) corresponding to original digital audio data. Through the similarity examination process, the time-scale modification processing section 2 extracts a basic period Lp from the original signal waveform. Concretely speaking, the time-scale modification processing section 2 calculates and examines similarities to extract the basic period Lp, as follows:

A minimal value Lmin is set as an initial value of a certain time length on the original signal waveform. Then, similarities are calculated and examined with respect to adjacent waveform segments each having a time length Lmin. Herein, calculation and examination is repeated by increasing the time length until the time length is increased to a maximal value Lmax. Then, a specific time length producing a best similarity is selected from among time lengths between Lmin and Lmax and is determined as the basic period Lp. Thus, as shown in FIGS. 6B, 7B, two waves A, B each having the basic period Lp are arranged adjacent to each other.

Figures 6A, 6B, 6C, 6D, 6E, 6F:
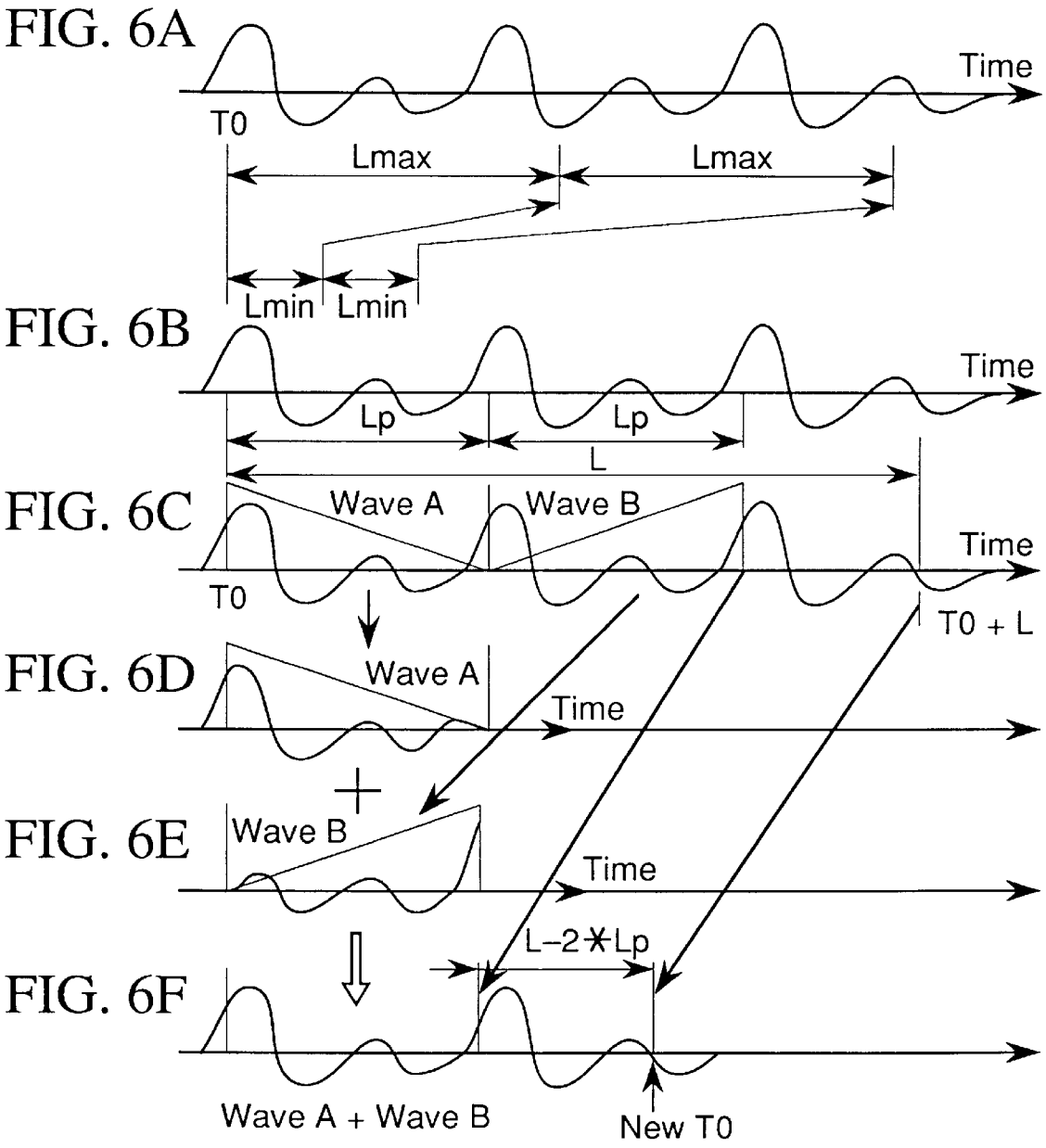
FIG. 6A shows an original signal waveform being subjected to time-scale compression.
FIG. 6B shows determination of a basic period Lp which is extracted from the signal waveform of FIG. 6A.
FIG. 6C shows waves A, B, which are partitioned from the signal waveform of FIG. 6A and each of which is subjected to windowed multiplication.
FIG. 6D shows a wave that is produced by windowed multiplication of the wave A.
FIG. 6E shows a wave that is produced by windowed multiplication of the wave B.
FIG. 6F shows a result of the time-scale compression in which a combined wave made by combining the waves of FIGS. 6D, 6E together is substituted for the two waves A, B.
Figures 7A, 7B, 7C, 7D, 7E, 7F:
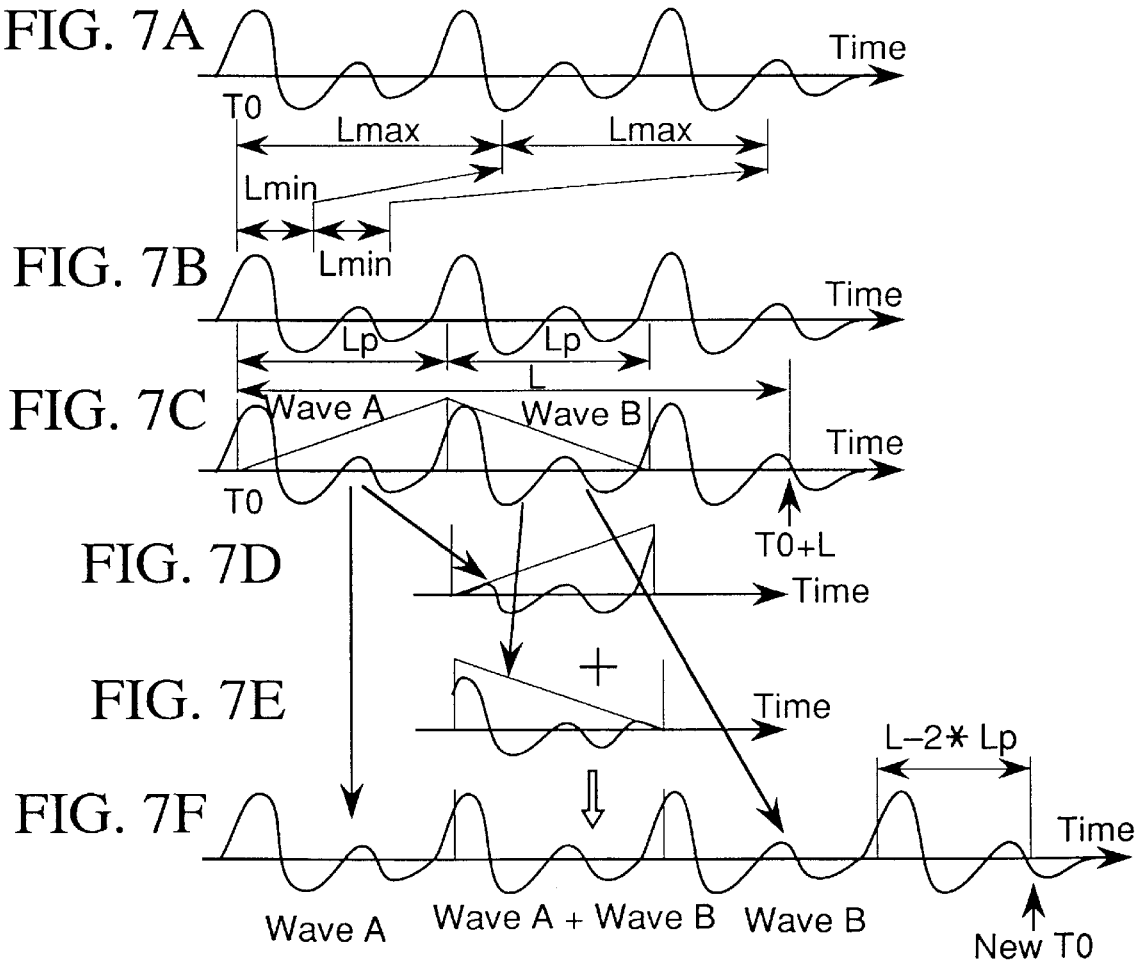
FIG. 7A shows an original signal waveform being subjected to time-scale expansion.
FIG. 7B shows determination of a basic period Lp which is extracted from the signal waveform of FIG. 7A.
FIG. 7C shows two waves A, B, which are partitioned from the signal waveform of FIG. 7A and each of which is subjected to windowed multiplication.
FIG. 7D shows a wave that is produced by windowed multiplication of the wave A.
FIG. 7E shows a wave that is produced by windowed multiplication of the wave B.
FIG. 7F shows a result of the time-scale expansion in which a combined wave made by combining the waves of FIGS. 7D, 7E together is inserted between the waves A, B.

Next, each of the waves A, B is multiplied by a specific time window function as shown in FIGS. 6C, 7C. In the compression process, a wave of FIG. 6D is produced by effecting multiplication of a window function having a level-decreasing slope on the wave A, while a wave of FIG. 6E is produced by effecting multiplication of a window function having a level-increasing slope on the wave B. In the expansion process, a wave of FIG. 7D is produced by effecting multiplication of a window function having a level-increasing slope on the wave A, while a wave of FIG. 7E is produced by effecting multiplication of a window function having a level-decreasing slope on the wave B. Those waves are combined together as shown in FIGS. 6F, 7F. Specifically, time-scale compression is accomplished by substituting a combined wave, in which the waves of FIGS. 6D, 6E overlap with each other, for the two waves A, B corresponding to the two basic periods, which is shown in FIG. 6F. In addition, time-scale expansion is accomplished by inserting the combined wave between the two waves A, B corresponding to the two basic periods, which is shown in FIG. 7F.

Figure 8:
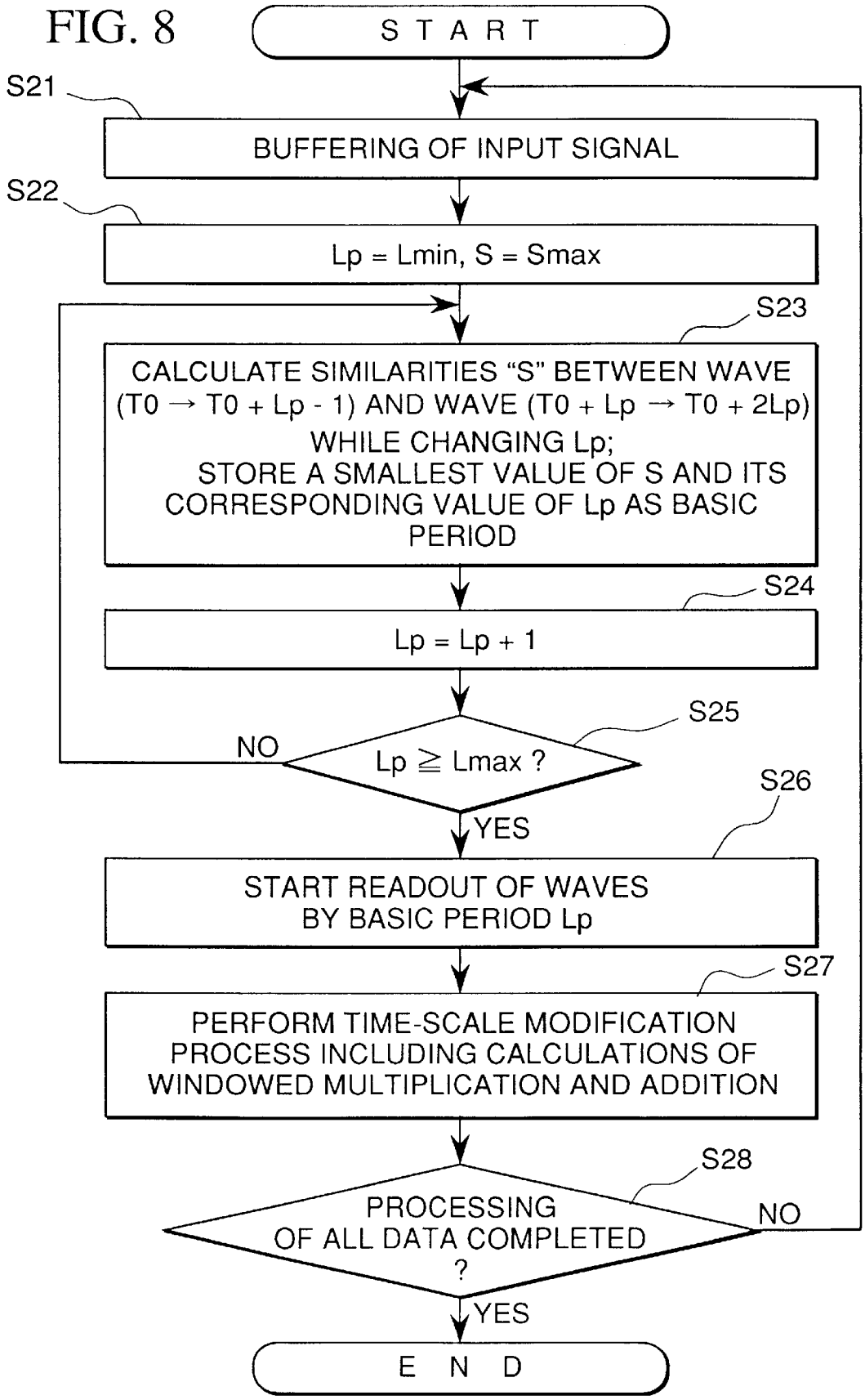
FIG. 8 is a flowchart showing a time-scale modification process being performed by a time-scale modification processing section shown in FIG. 1.

FIG. 8 is a flowchart showing procedures of a time-scale modification process being effected by the time-scale modification processing section 2.

In step S21, an input signal x(t) of a certain amount of time which is needed for the time-scale processing is stored in the delay buffer 11. The delay buffer 11 needs a storage capacity corresponding to at least 2×Lmax samples, for example. In step 822, an initial value corresponding to a minimal value Lmin is set to the time length (Lp) which is used for calculation and examination of similarities, and a maximal value Smax is initially set to a similarity S. Through steps S23 to S25, the time-scale modification processing section 2 calculates similarities between adjacent waveform segments by incrementing the time length Lp until the time length Lp is increased to Lmax. Herein, it determines a time length that provides a best similarity between the waveform segments within time lengths between Lmin and Lmax. As shown in FIGS. 6C, 7C, the similarity is calculated and examined between the wave A, which lies in a first time period between given time points "T0" and "T0+Lp−1", and the wave B which lies in a second time period between "T0+Lp" and "T0+2Lp". Using "tx" and "tx+Lp" which are respectively located in the first and second time periods in a time-axis direction, the similarity S is calculated by square errors in accordance with an equation (4), as follows:

$$S = \frac{1}{Lp}\sum_{i=0}^{Lp-1}\{D(tx) - D(tx + Lp)\}^2 \tag{4}$$

The above equation shows that similarity becomes good (or high) as S becomes small. This equation shows merely an example of similarity calculation. So, it is possible to use an absolute sum of errors and auto-correlation function other than the square errors.

Figures 9A, 9B:
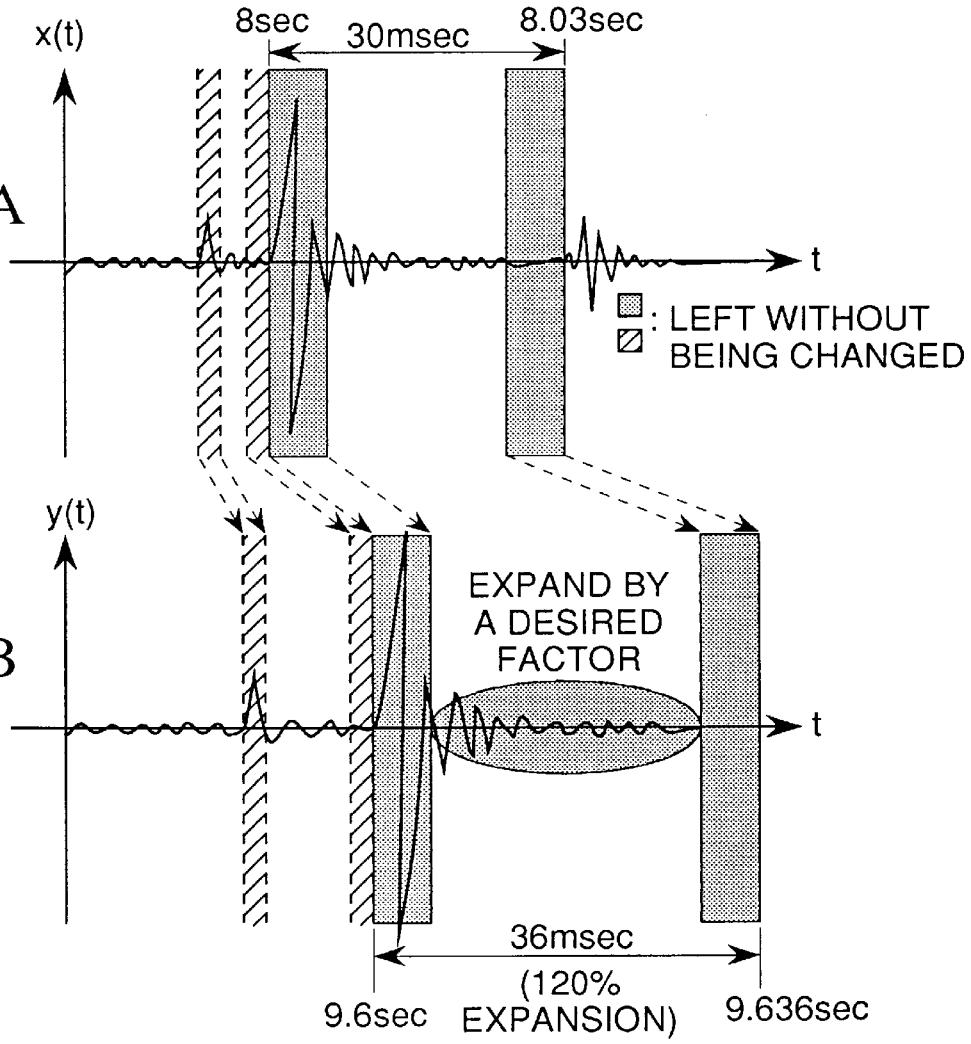
FIG. 9A shows an example of an original signal waveform which is subjected to time-scale expansion.
FIG. 9B shows a result of the time-scale expansion in which only an intermediate signal portion is expanded while attacks and their proximal portions are not substantially changed at all.

FIG. 9A shows a signal waveform with respect to an interval of time between attacks, which includes a first signal corresponding to a front-end portion (i.e., first attack) and a second signal corresponding to a back-end portion (i.e., preceding portion preceding to a second attack). As shown in FIG. 9B, the time-scale modification process is effected on an intermediate signal portion between the first and second signals without changing the first and second signals. In addition, the present embodiment provides smooth connection between a time-scale modified signal and an original signal which is not subjected to time-scale modification. Herein, the present embodiment is designed to maintain an original waveform of an attack which is highlighted without substantially changing it. So, even if the time-scale modification is performed on original waveforms, it is possible to produce sounds which are very similar to original sounds.

As described above, it is important to effect the time-scale modification process on the intermediate signal portion between attacks without using other signal portions before and after the attacks. In addition, it is necessary to smoothly connect the time-scale modified signal with the original signal which is not subjected to time-scale modification. If the time-scale modification process is performed using the aforementioned PICOLA method, un-processed portions which are not processed within prescribed times are certainly contained in output waveforms. Particularly, such an un-processed portion becomes very long in a waveform portion whose time-scale modification factor is approximately 100%.

FIGS. 10A to 10D show an example of a countermeasure to cope with the un-processed portions in the output waveforms. That is, a certain amount of data including data which are needed for cross-fade are extracted from the back-end portion of the signal waveform between the attacks in connection with the un-processed portion which is not processed during the prescribed time for the time-scale expansion process. Then, a part of the extracted data is subjected to cross-fading to provide substantial matching of data with respect to time. FIGS. 11A to 11D show a modified technique of the time-scale expansion process in which if there is a shortage of data for cross-fading in the time-scale expansion process, a specific part of data is repeatedly used to achieve the time-scale expansion. This technique is effective if a pointer interval is too large to process all the data.

FIGS. 12A to 12D show a technique that is effective for time-scale compression. Like the aforementioned time-scale expansion, this technique performs a cross-fade operation on the un-processed portion in the time-scale compression. In this case, no shortage occurs in an amount of data being compressed, so a certain amount of data containing data which is needed for cross-fading is extracted from the back-end portion of the signal waveform between the attacks and is partially subjected to cross-fading.

The aforementioned processes are described with regard to a monaural channel. Of course, they are applicable to stereo sound systems as well. That is, they are applicable to rhythm source signals which are stereo signals corresponding to left and right channels (Lch, Rch). However, if the aforementioned processes are effected independently on each of the signals of the left and right channels so that stereo sounds are being reproduced, there is a drawback in which sound localization is broadened. It is possible to offer reasons why the sound localization is broadened with respect to the stereo sounds being reproduced using the time-scale modification, as follows:

When the time-scale modification is effected independently on each of the left-channel signal and right-channel signal, cross-fade points may be shifted from each other between the left and right channels. This causes variations of phases between the left-channel and right-channel signals, so that sound localization is being greatly damaged.

To cope with the aforementioned drawback in the stereo sound system, it is possible to provide a time-scale modification apparatus shown in FIG. 13. Herein, an attack detection section 21 and a pointer control section 22 are provided to the input both of input signals of the left and right channels (Lch, Rch). In addition, time-scale modification processing sections 23, 24 are provided for the input signals Lch, Rch respectively. The attack detection section 21 performs attack detection processes respectively on the input signals Lch, Rch to detect "common" attack positions between the left and right channels. In addition, the pointer control section 22 performs pointer evaluation processes (or processes for determination of Lp) respectively on the input signals Lch, Rch to determine a "common" time length Lp between the left and right channels. Using the common attack positions and the common time length Lp, the time-scale modification processing sections 23, 24 perform time-scale modification processes respectively on the input signals Lch, Rch to produce output signals of the left and right channels. Thus, it is possible to prevent original sound localization from being damaged so much while suppressing phase variations between the left and right channels to the minimum.

Lastly, this invention can be provided in forms of storage devices or media such as floppy disks, hard disks, memory cards and the like, which store programs and data actualizing functions of the present embodiment. Or, programs and data of the present embodiment can be downloaded to a computer system to actualize the time-scale modification techniques from a computer network such as the Internet by way of MIDI terminals, for example.

As described heretofore, this invention has a variety of technical features and effects, which are summarized as follows:

(1) The time-scale modification process (e.g., expansion or compression) is effected on intermediate signal portions between attacks, which are detected from original signal waveforms of rhythm source signals. So, it is possible to prevent double beat from being caused to occur in reproduced sounds corresponding to rhythm source signals which are subjected to the time-scale modification. Herein, an interval of time between attacks on a signal waveform can be easily compressed or expanded in response to a factor of time-scale compression or expansion. This perfectly secures original correlation being maintained between the attacks before and after the time-scale modified portion. Thus, it is possible to prevent rhythm disorder from being caused to occur in reproduced rhythm sounds.

(2) The time-scale modification process is effected with respect to a certain signal waveform portion except attacks and their proximal portions in an original signal waveform corresponding to an original rhythm source signal. Herein, both end portions of a time-scale modified signal portion are smoothly connected with other original signal waves which are not subjected to the time-scale modification. In order to do so, both of the end portions of the time-scale modified signal portion are partially deformed to imitate the other original signal waves. Or, they are subjected to cross-fading to provide smooth connection. In this case, attack waves are maintained without being substantially changed, so it is possible to reproduce sounds which are very similar to original sounds.

As this invention may be embodied in several forms without departing from the spirit of the essential characteristics thereof, the present embodiment and its techniques are illustrative and not restrictive, the scope of the invention being defined by the appended claims rather than by the description preceding them. All changes that fall within the metes and bounds of the claims, or within the range equivalency of such metes and bounds are therefore intended to be embraced by the claims.

What is claimed is:

1. A time-scale modification method comprising the steps of:

detecting attack positions from rhythm source signals, which are subjected to time-scale modification; and effecting a time-scale modification process on intermediate signal portions of the rhythm source signals between the attack positions.

2. A time-scale modification method according to claim 1 further comprising the steps of:

extracting the intermediate signal portions from the rhythm source signals by excluding the attack positions and their proximal portions as other signal portions; and smoothly connecting end portions of the intermediate signal portions subjected to the time-scale modification process with the other signal portions which are not subjected to the time-scale modification process.

3. A time-scale modification method according to claim 1 wherein the time-scale modification process corresponds to expansion or compression with respect to time.

4. A time-scale modification method according to claim 2 wherein the time-scale modification process corresponds to expansion or compression with respect to time.

5. A time-scale modification apparatus comprising:

an attack position detector for detecting attack positions from rhythm source signals, which are subjected to time-scale modification; and a time-scale modification processor for effecting a time-scale modification process on intermediate signal portions of the rhythm source signals between the attack positions by a time-scale modification factor which is designated in advance such that the rhythm source signals are not substantially changed in pitch.

6. A time-scale modification apparatus according to claim 5 wherein the time-scale modification process is effected on the intermediate signal portions which are extracted from the rhythm source signals by excluding the attack positions and their proximal portions as other signal portions, so that end portions of the intermediate signal portions subjected to the time-scale modification process are smoothly connected with the other signal portions which are not subjected to the time-scale modification process.

7. A time-scale modification apparatus according to claim 5 wherein the time-scale modification process corresponds to expansion or compression with respect to time, so that the time-scale modification factor corresponds to an expansion factor or a compression factor.

8. A time-scale modification apparatus according to claim 6 wherein the time-scale modification process corresponds to expansion or compression with respect to time, so that the time-scale modification factor corresponds to an expansion factor or a compression factor.

9. A time-scale modification method comprising the steps of:

inputting rhythm source signals containing waveforms;

calculating similarities between adjacent waveforms, which are extracted by time lengths being sequentially changed;

determining a basic period corresponding to a time length that provides a best similarity between the adjacent waveforms;

partitioning a selected part of the waveforms of the rhythm source signals into two waveforms, each corresponding to the basic period, which are subjected to time-scale modification;

effecting a time-scale modification process on the two waveforms to produce a combined waveform in accordance with a desired time-scale modification factor; and smoothly connecting the combined waveform with original waveforms of the rhythm source signals.

10. A time-scale modification method according to claim 9 wherein when the time-scale modification process corresponds to a compression process to compress the selected part of the waveforms of the rhythm source signals, the combined waveform substitutes for the two waveforms in the waveforms of the rhythm source signals.

11. A time-scale modification method according to claim 9 wherein when the time-scale modification process corresponds to an expansion process to expand the selected part of the waveforms of the rhythm source signals, the combined waveform is inserted between the two waveforms in the waveforms of the rhythm source signals.

12. A time-scale modification method according to claim 10 wherein the time-scale modification process is effected in such a way that one of the two waveforms is multiplied with a level-increasing slope while the other is multiplied with a level-decreasing slope, the two waveforms respectively multiplied by the slopes being added together to form the combined waveform.

13. A time-scale modification method according to claim 11 wherein the time-scale modification process is effected in such a way that one of the two waveforms is multiplied with a level-increasing slope while the other is multiplied with a level-decreasing slope, the two waveforms respectively multiplied by the slopes being added together to form the combined waveform.

14. A time-scale modification method according to claim 9 further comprising the steps of:

detecting attacks on the waveforms of the rhythm source signals by using thresholds which are determined in advance; and extracting the selected part of the waveforms by excluding the attacks from the rhythm source signals.

15. A machine-readable media storing programs and data that cause a computer system to perform a time-scale modification method comprising the steps of:

detecting attack positions from rhythm source signals, which are subjected to time-scale modification; and effecting a time-scale modification process on intermediate signal portions of the rhythm source signals between the attack positions.

16. A machine-readable media according to claim 15, wherein the time-scale modification method further comprises the steps of:

extracting the intermediate signal portions from the rhythm source signals by excluding the attack positions and their proximal portions as other signal portions; and smoothly connecting end portions of the intermediate signal portions subjected to the time-scale modification process with the other signal portions which are not subjected to the time-scale modification process.

17. A machine-readable media storing programs and data that cause a computer system to perform a time-scale modification method comprising the steps of:

inputting rhythm source signals containing waveforms;

calculating similarities between adjacent waveforms, which are extracted by time lengths being sequentially changed;

determining a basic period corresponding to a time length that provides a best similarity between the adjacent waveforms;

partitioning a selected part of the waveforms of the rhythm source signals into two waveforms, each corresponding to the basic period, which are subjected to time-scale modification;

effecting a time-scale modification process on the two waveforms to produce a combined waveform in accordance with a desired time-scale modification factor; and smoothly connecting the combined waveform with original waveforms of the rhythm source signals.

18. A machine-readable media according to claim 17, wherein the time-scale modification method is executed in such a way that when the time-scale modification process corresponds to a compression process to compress the selected part of the waveforms of the rhythm source signals, the combined waveform substitutes for the two waveforms in the waveforms of the rhythm source signals.

19. A machine-readable media according to claim 17, wherein the time-scale modification method is executed in such a way that when the time-scale modification process corresponds to an expansion process to expand the selected part of the waveforms of the rhythm source signals, the combined waveform is inserted between the two waveforms in the waveforms of the rhythm source signals.

* * * * *